US008430686B2

(12) United States Patent
Sheehan et al.

(10) Patent No.: US 8,430,686 B2
(45) Date of Patent: Apr. 30, 2013

(54) ANTI-ROTATION PANEL MOUNT AUDIO FILL CONNECTOR

(75) Inventors: Howard M. Sheehan, Bloomfield, NY (US); Michael D. Stevens, Avon, NY (US)

(73) Assignee: Harris Corporation, Melbourne, FL (US)

( * ) Notice: Subject to any disclaimer, the term of this patent is extended or adjusted under 35 U.S.C. 154(b) by 93 days.

(21) Appl. No.: 12/959,489

(22) Filed: Dec. 3, 2010

(65) Prior Publication Data

US 2012/0142213 A1 Jun. 7, 2012

(51) Int. Cl.
*H01R 13/74* (2006.01)

(52) U.S. Cl.
USPC ..... 439/551

(58) Field of Classification Search ..... 439/551, 439/550, 556, 549, 578, 736; 248/27.1
See application file for complete search history.

(56) References Cited

U.S. PATENT DOCUMENTS

| | | | | | |
|---|---|---|---|---|---|
| 3,936,132 | A * | 2/1976 | Hutter | 439/551 |
| 3,998,515 | A * | 12/1976 | Panek | 439/198 |
| 4,726,788 | A * | 2/1988 | F'Geppert | 439/551 |
| 4,772,221 | A * | 9/1988 | Kozlof | 439/544 |
| 4,797,120 | A * | 1/1989 | Ulery | 439/578 |
| 5,145,412 | A * | 9/1992 | Tan et al. | 439/620.03 |
| 5,205,760 | A * | 4/1993 | Agut Sanz | 439/551 |
| 5,383,272 | A * | 1/1995 | Mattingly et al. | 29/876 |
| 5,413,502 | A * | 5/1995 | Wang | 439/551 |
| 5,704,806 | A * | 1/1998 | Post et al. | 439/546 |
| 5,759,072 | A * | 6/1998 | Chadbourne et al. | 439/814 |
| 5,823,811 | A * | 10/1998 | Blanchfield et al. | 439/274 |
| 5,879,166 | A * | 3/1999 | Wang | 439/63 |
| 6,450,834 | B1 * | 9/2002 | Polgar et al. | 439/546 |
| 6,464,523 | B1 * | 10/2002 | LeVine | 439/271 |
| 6,942,491 | B2 * | 9/2005 | Khemakhem | 439/63 |
| 7,114,956 | B2 * | 10/2006 | Kreitzer et al. | 439/63 |
| 7,234,956 | B2 * | 6/2007 | Kauffman | 439/349 |
| 7,255,585 | B2 * | 8/2007 | Kameyama et al. | 439/271 |
| 7,614,910 | B2 * | 11/2009 | Croteau et al. | 439/573 |

* cited by examiner

*Primary Examiner* — Alexander Gilman
(74) *Attorney, Agent, or Firm* — Harness, Dickey & Pierce, PLC

(57) ABSTRACT

An electrical connector assembly includes a connector body having a connector longitudinal axis. A wing portion integrally connected to the connector body has an aperture with an aperture longitudinal axis oriented parallel to the connector longitudinal axis. A pin is fixed in the wing portion aperture having a pin portion extending away from the wing portion such that a pin longitudinal axis is oriented parallel to the connector longitudinal axis. A threaded connection portion axially extends from the connector body co-axial to the connector longitudinal axis. A panel nut is threaded onto the threaded connection portion to retain a panel between the panel nut and the connector body with the threaded connection portion extending through a panel aperture. The pin is received in a panel bore in an installed condition preventing connector assembly axial rotation with respect to the connector longitudinal axis when torque is applied to the panel nut.

19 Claims, 6 Drawing Sheets

ANTI-ROTATION PANEL MOUNT AUDIO FILL CONNECTOR

GOVERNMENT CONTRACT

This invention was made with Government support under Government Contract No. N6875-07-5386 awarded by the Space And Naval Warfare Systems Command (SPAWAR). The Government has certain rights in this invention.

FIELD

The present disclosure relates to panel mounted electrical connectors having multiple conductor pins, the connectors mounted using a jam nut.

BACKGROUND

This section provides background information related to the present disclosure which is not necessarily prior art.

Electrical connector assemblies are known such as those identified by MIL-DTL-55116 which have opposed conductor pins extending from a body of the connector assembly and a bayonet connection portion. Mount flats are commonly provided on a circular end face of the connector body which abut with flats created in a corresponding receiving aperture of a panel to which the connector assembly is mounted with the threaded connection portion extending through the receiving aperture. The mount flats are intended to substantially prevent axial rotation of the connector assembly when a panel nut is rotated onto threads of the threaded connection portion. Any axial rotation of the connector body is known to damage printed circuit pin solder joints of the conductor to a flex printed circuit or printed circuit board when a torque is applied to the panel nut, or when a subsequent connector is joined to the connector assembly. The torque is required to prevent loosening of the connector assembly from the panel, electrical bonding of the connector to the panel, and environmental sealing of the connector to the panel.

Known solutions to eliminate the torque induced conductor pin damage include addition of standoffs on a board which is epoxy attached secured with threaded fasteners to the connector assembly, and procedures which require an installer to apply a separate tooling fixture to axially restrain/hold the connector to prevent axial rotation of the connector assembly during panel nut installation. These solutions are time consuming, require additional installer cost, and must be repeated for each connector assembly installed to the panel.

SUMMARY

This section provides a general summary of the disclosure, and is not a comprehensive disclosure of its full scope or all of its features.

According to several embodiments, an electrical connector assembly includes a connector having a connector body having a connector longitudinal axis. A wing (similar to a lobe on a cam shaft) portion is connected to the connector body and extends radially outward with respect to the connector longitudinal axis. An anti-rotation member is fixed to the wing portion. A portion of the anti-rotation member extends away from the wing portion and is oriented on an anti-rotation member longitudinal axis aligned substantially parallel to the connector longitudinal axis.

According to other embodiments, an electrical connector assembly includes a connector body having a connector longitudinal axis. A wing portion is integrally connected to the connector body. The wing portion has an aperture having an aperture longitudinal axis oriented parallel to the connector longitudinal axis. A pin is fixed in the aperture of the wing portion having a portion of the pin extending away from the wing portion such that a longitudinal axis of the pin is oriented parallel to the connector longitudinal axis.

According to further embodiments, an electrical connector assembly includes a connector body having a connector longitudinal axis. A threaded connection portion axially extends from the connector body co-axial to the connector longitudinal axis, the threaded connection portion having a first conductor pin cavity and a plurality of mounting threads. A plurality of first conductor pins is positioned in the first conductor pin cavity. A wing portion is integrally connected to the connector body, the wing portion having an aperture oriented substantially parallel to the connector longitudinal axis. A pin is fixed in the aperture of the wing portion having a portion of the pin extending away from the wing portion such that a longitudinal axis of the pin is oriented substantially parallel to the connector longitudinal axis.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 10:
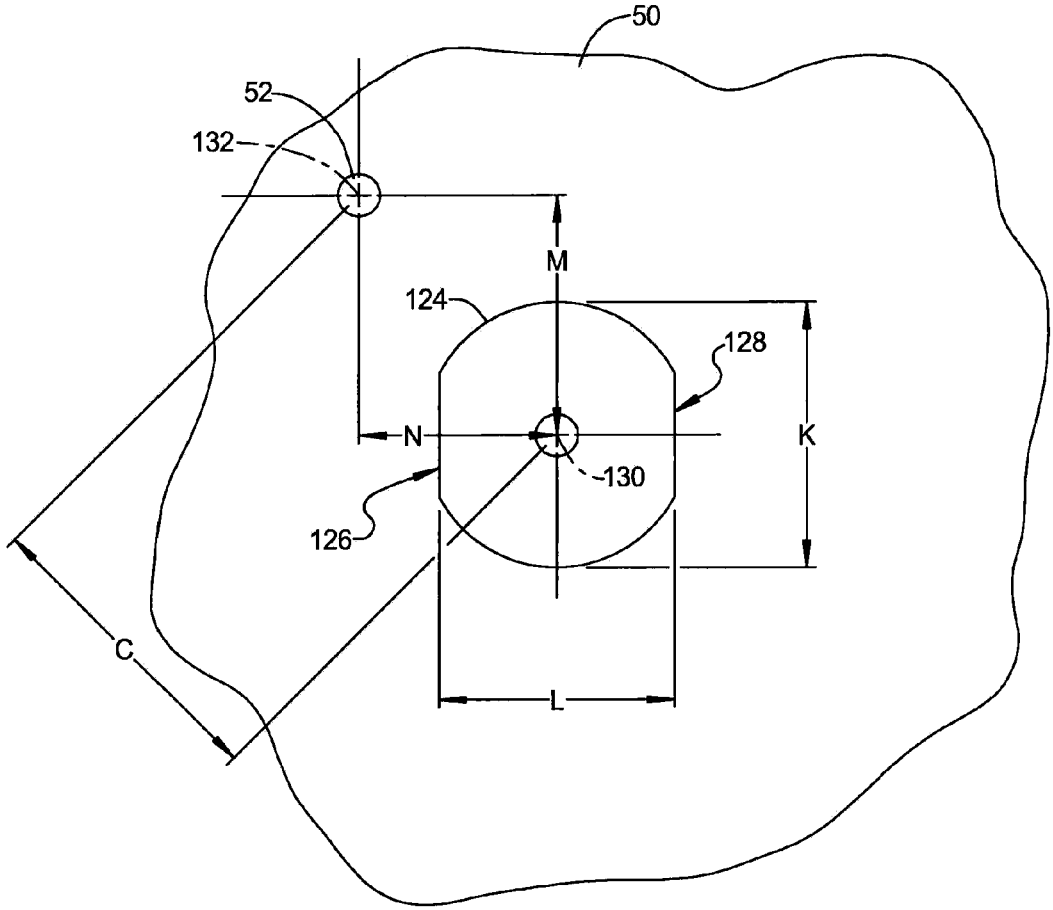
FIG. 10 is a front elevational view of a panel having a panel aperture created to receive a connector of the present disclosure.

Example embodiments will now be described more fully with reference to the accompanying drawings, wherein referring to FIG. 1, a first connector assembly 10 includes a connector body 12 having a threaded connection portion 14 axially extending from the connector body 12 and co-axially oriented on a connector longitudinal axis 16. The threaded connection portion 14 includes a plurality of mounting threads 18 which are modified by creation of opposed first and second thread flats 20*a*, 20*b*, which are tangentially created on the mounting threads 18. A mount portion 22, having a substantially cylindrical shape, integrally connects connector body 12 to threaded connection portion 14. Mount portion 22 also includes opposed first and second mount flats 24*a*, 24*b*, which are aligned with individual ones of the thread flats 20*a*, 20*b*. The purpose for the mount flats 24 and thread flats 20 will be better described in reference to FIG. 10.

A seal cavity 26 is created external to mount portion 22 and internal with respect to an external wall 27. A planar end face 28 is created on a threaded connection portion facing end of external wall 27. An anti-rotation member 30 is fixed with respect to a wing portion 32 extending radially outward from and integrally connected to connector body 12. Anti-rotation member 30 is aligned on an anti-rotation member longitudinal axis 34 which is oriented parallel to connector longitudinal axis 16. An extending portion 33 of anti-rotation member 30 is outwardly positioned with respect to wing portion 32 and is directed toward threaded connection portion 14. Threaded connection portion 14 further includes a first conductor pin cavity 35 which receives a plurality of conductor pins which will be shown and better described in reference to FIGS. 2 through 5.

Figure 1:
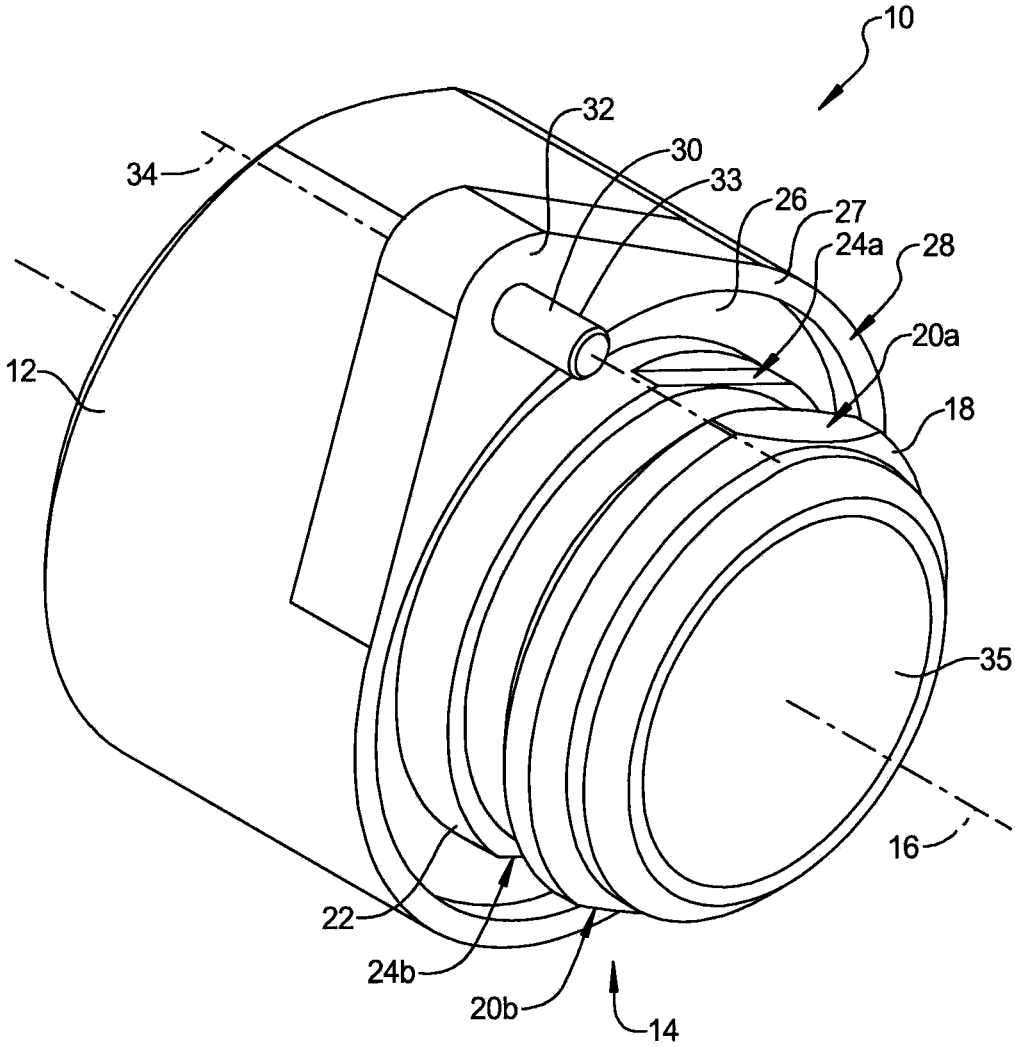
FIG. 1 is a front right perspective view of a connector of the present disclosure.

Referring to FIG. 2 and again to FIG. 1, a conductor assembly 36 is received and fixedly positioned within first conductor pin cavity 35. A jam or panel nut 38 is internally threaded to be connected onto mounting threads 18 outside of conductor assembly 36. Conductor assembly 36 includes a plurality of first conductor pins 40 which are oriented parallel with respect to connector longitudinal axis 16. A connector seal 42, such as an O-ring or resilient member gasket, is positioned in seal cavity 26 and extends partially beyond planar end face 28 and faces panel nut 38 when panel nut is installed as shown.

Connector body 12 includes a second body cavity 44 having a cavity seal member 45, such as an O-ring, retained therein by an end retaining wall 46. The mount flats 24 extend partially beyond connector seal 42. Panel nut 38 is installed in a nut installation direction "A" by engaging onto mounting threads 18.

Figure 3:
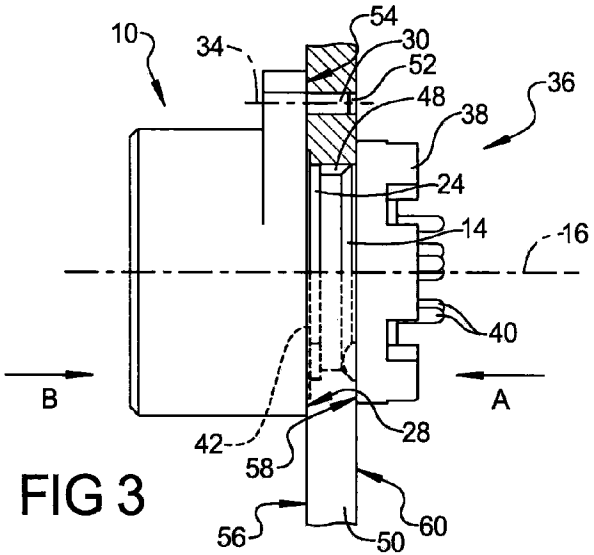
FIG. 3 is a partial cross sectional front elevational view of the connector of FIG. 2 after mounting to a panel.

Referring to FIG. 3, first connector assembly 10 is shown in an installed position having threaded connection portion 14 inserted through a panel aperture 48 of a panel 50. At the same time, anti-rotation member 30 is slidably received in a bore 52 also created in panel 50. Bore 52 is therefore co-axially aligned with anti-rotation member 30. In the installed position, a wing portion end face 54 and planar end face 28, which are co-planar with each other, contact a first panel face 56 of panel 50. Contact of first panel end face 56 compresses connector seal 42. Panel nut 38 is installed in the nut installation direction "A" until a nut end face 58 directly contacts a second panel face 60 to complete the installation of connector body 12 in a body installation direction "B".

Figure 11:
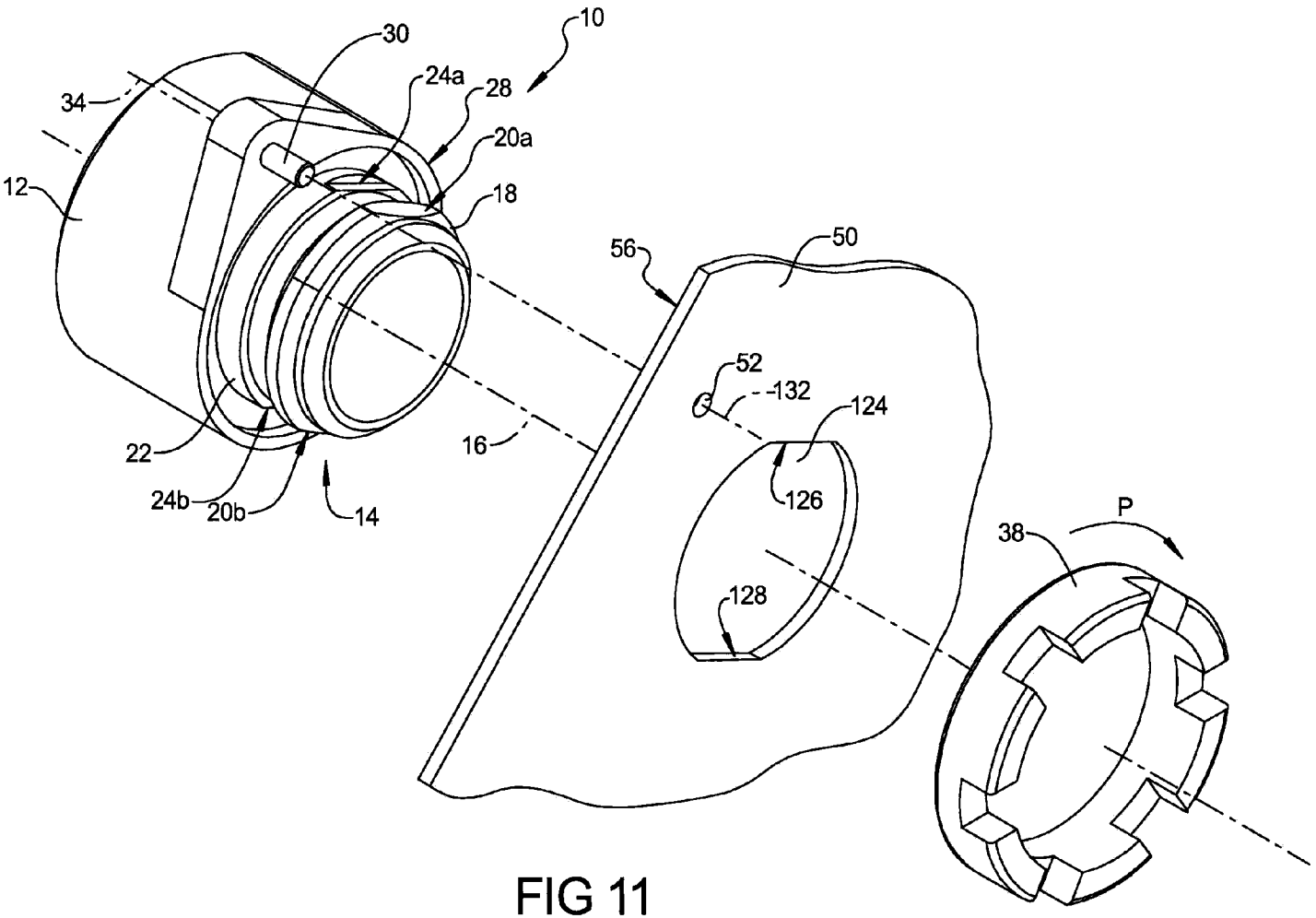
FIG. 11 is a front right perspective assembly view of the connector of FIG. 1 aligned for insertion into the panel aperture of FIG. 10.

Referring to FIG. 4 and again to FIG. 1, wing portion 32 includes a wing aperture 62 which frictionally engages and retains anti-rotation member 30. A spacing dimension "C" is defined between connector longitudinal axis 16 and anti-rotation member longitudinal axis 34, which provides clearance between anti-rotation member 30 in its installed position with respect to an outer perimeter of panel nut 38. The plurality of first conductor pins 40 can be arranged as shown having a first portion circularly surrounding a centrally located one of the conductor pins 40. The anti-rotation member longitudinal axis 34 is oriented at an angle $\alpha$ with respect to a body axis 63. Body axis 63 is, in turn, oriented perpendicular with respect to thread flats 20*a*, 20*b*. A body diameter "D", including external wall 27, is greater than a corresponding diameter of panel nut 38. Thread flats 20*a*, 20*b* have a thread flat spacing dimension "E" which will be better described in reference to FIGS. 10 and 11.

Figure 2:
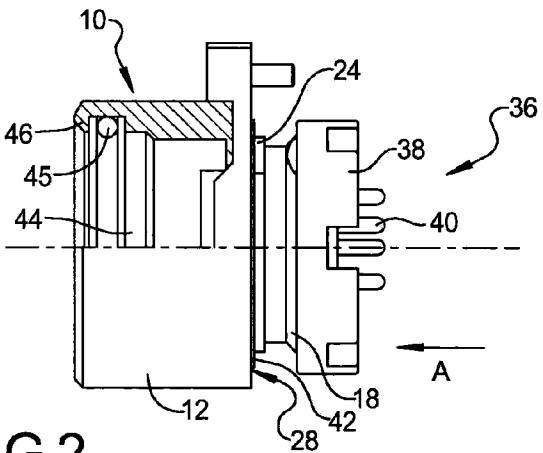
FIG. 2 is a partial cross sectional front elevational view of the connector of FIG. 1.

Referring to FIG. 5 and again to FIG. 2, a plurality of second conductor pins 64 of a second conductor assembly 65 are received within second body cavity 44 of connector body 12. Second conductor pins 64 are, therefore, directed oppositely with respect to first conductor pins 40. Second conductor pins 64 are arranged on a conductor pin circle 66 similar to first conductor pins 40 and can include a central conductor pin 68 coaxially aligned with connector longitudinal axis 16.

Figure 6:
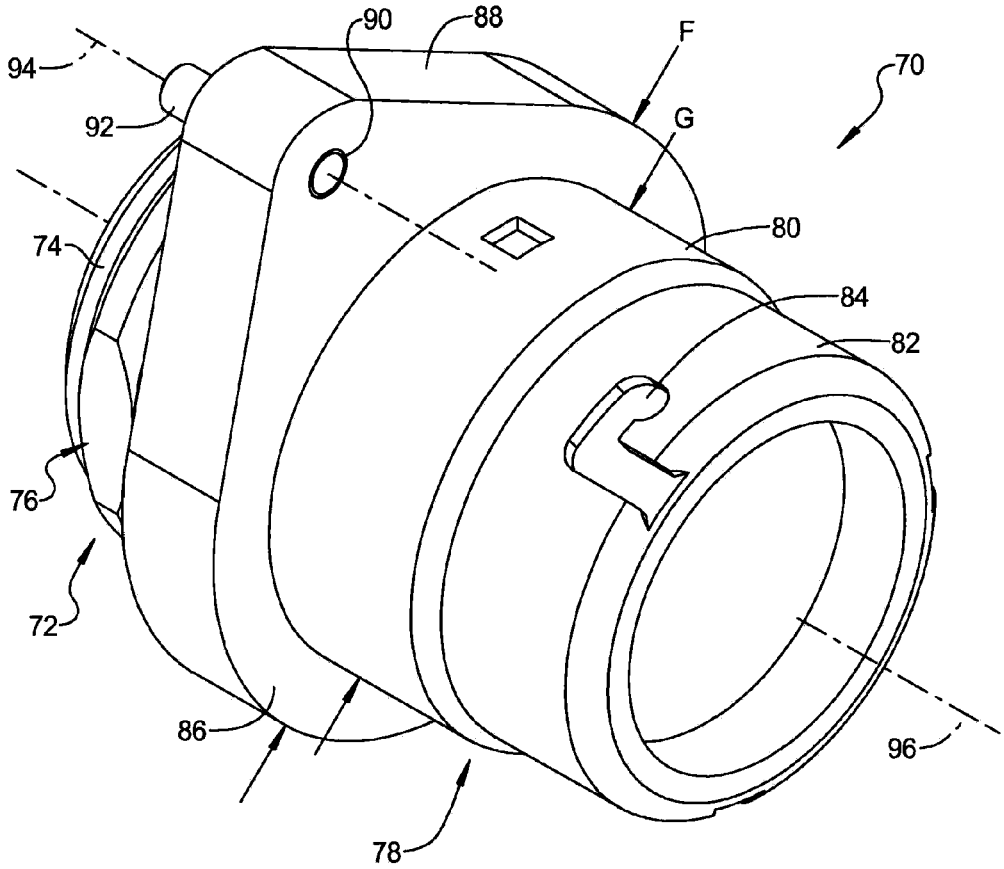
FIG. 6 is a front right perspective view of another embodiment of a connector of the present disclosure.

Referring to FIG. 6, according to additional embodiments, a second connector assembly 70 includes a threaded connection portion 72 having a plurality of mounting threads 74 and opposed thread flats 76 which are similar in function to the corresponding components of first connector assembly 10 described in reference to FIG. 1. Threaded connection portion 72 is integrally connected to a connector body 78 which is created having a first body portion 80 integrally connected to a second body portion 82. A body locking slot 84 which, according to several embodiments, is created in an L-shape is used for releasably connecting second connector assembly 70 to a further electrical connection (not shown). A connector body ring 86, having a body ring diameter "F", is positioned between threaded connection portion 72 and connector body 78. Connector body ring 86 is integrally connected to both threaded connection portion 72 and connector body 78. Connector body ring 86 has a body ring diameter "F" which is greater than a first body portion diameter "G" of first body portion 80.

A wing portion 88 extends radially outward from connector body ring 86 to position a wing aperture 90 outward with respect to a connector longitudinal axis 96. An anti-rotation member 92 is frictionally received within wing aperture 90 and extends partially away from wing portion 88 toward threaded connection portion 72. Anti-rotation member 92 is oriented co-axially with an anti-rotation member longitudinal axis 94 which is oriented parallel with respect to connector longitudinal axis 96. Other features of second connector assembly 70 are similar to those previously described with respect to first connector assembly 10.

Referring to FIG. 7 and again to FIG. 6, an installed condition for second connector assembly 70 is shown. Second connector assembly 70 includes a second conductor assembly 98 positioned in and fixed with respect to second body portion 82. In the installed condition, threaded connection portion 72 is inserted through a panel aperture 100 until a body end face 102 of connector body ring 86 contacts a first panel face 104 of a panel 106. At this time, a connector seal 108 is partially compressed by contact with first panel face 104. At the same time, anti-rotation member 92 is slidably received within a bore 110, also created in panel 106, which is co-axially aligned with anti-rotation member longitudinal axis 94. Bore 110 can be a through bore or a blind bore.

A jam nut or panel nut 112 is threadably engaged with mounting threads 74 and thereby installed in the nut installation direction "A" with second connector assembly 70 being installed in the body installation direction "B". Panel nut 112 is rotated until a nut end face 114 directly contacts a second panel face 116 of panel 106. A torque ranging from approximately 40 inch pounds to approximately 120 inch pounds can be applied to panel nut 112 to thereafter prevent loosening of panel nut 112 during use. The insertion of anti-rotation member 92 in bore 110 prevents axial rotation of second connector assembly 70 with respect to connector longitudinal axis 96 as the panel nut 112 is torqued to its desired range.

A plurality of first conductor pins 118 are oriented parallel to connector longitudinal axis 96 and extend outwardly with respect to panel nut 112. At the same time, a plurality of second conductor pins 120, which are also oriented parallel with respect to connector longitudinal axis 96, are positioned within second body portion 82. Opposed first and second mount flats 122*a*, 122*b* (only first mount flat 122*a* is visible in this view) are positioned, as shown, for engagement within panel aperture 100, which will be described in better detail in reference to FIGS. 10 and 11.

Figure 5:
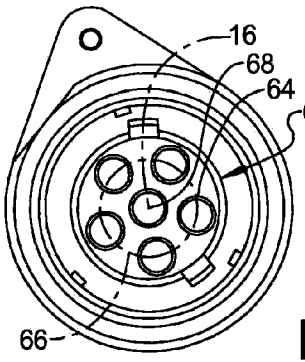
FIG. 5 is a rear end elevational view of the connector of FIG. 1.
Figure 4:
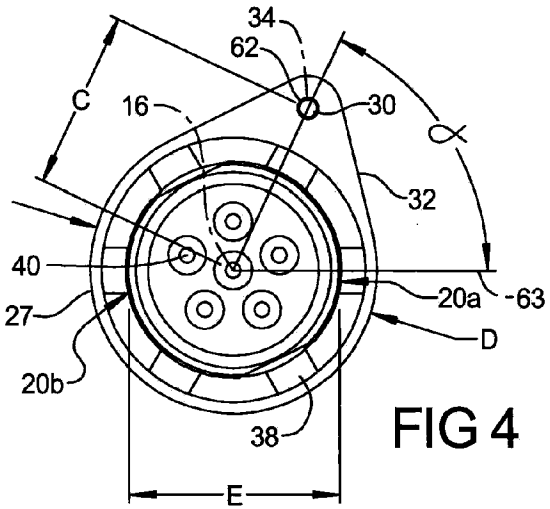
FIG. 4 is a front end elevational view of the connector of FIG. 1.

Referring to FIG. 8 and again to FIGS. 4 and 5, the plurality of second conductor pins 120 can be similarly arranged with respect to the configuration of second conductor pins 64 of first connector assembly 10. The wing aperture 90 is spaced with respect to connector longitudinal axis 96 such that anti-rotation member longitudinal axis 94 is positioned at a spacing dimension "H" with respect to connector longitudinal axis 96. Spacing dimension "H", similar to spacing dimension "C" ensures that anti-rotation member 92 can resist the torque applied by installation of panel nut 112 to prevent axial rotation of second connector assembly 70. Spacing dimension "H" is also selected to ensure clearance is provided for a bearing surface for the panel nut 112 even when panel bore 110 is a blind bore, without limitation due to a thickness of panel 106.

Figure 9:
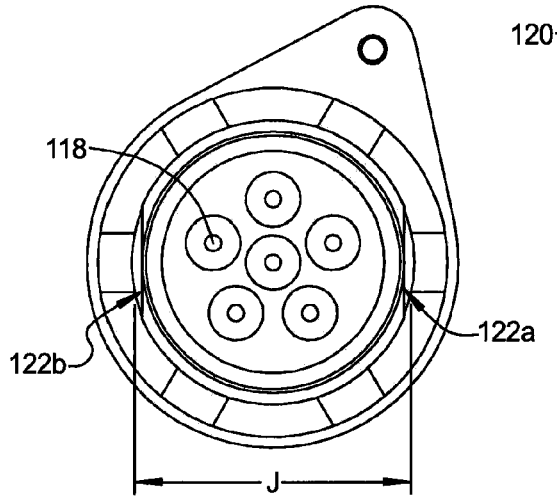
FIG. 9 is a front end elevational view of the connector of FIG. 6.

Referring to FIG. 9, first conductor pins 118 are oriented substantially parallel to connector longitudinal axis 96 (extending toward and away from the viewer in FIG. 9). A total of six (6) first conductor pins 118 are shown, however the present disclosure is not limited to the quantity of first conductor pins 118. A thread flat spacing dimension "J", between opposed first and second mount flats 122*a*, 122*b* is provided whose function will be described in better detail in reference to FIGS. 10 and 11.

Figure 7:
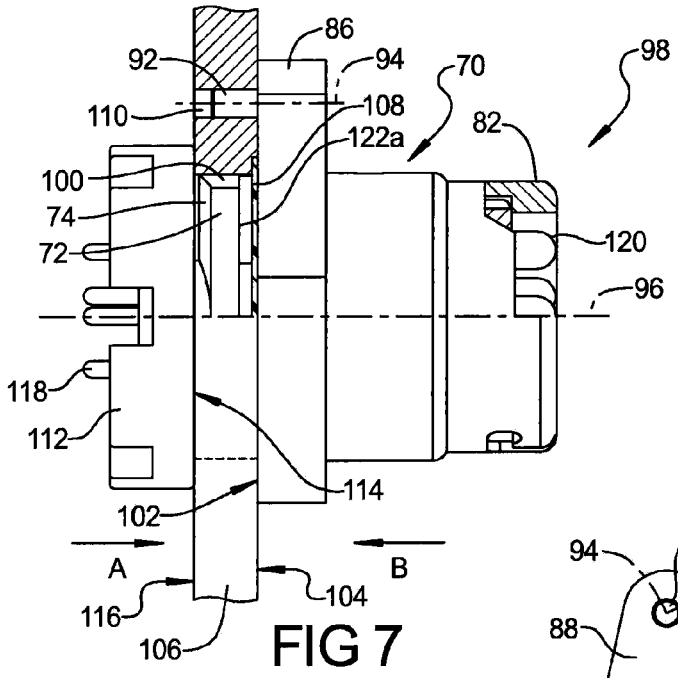
FIG. 7 is a partial cross sectional front elevational view of the connector of FIG. 6.

Referring to FIG. 10 and again to FIGS. 1, 6, and 7, panels that receive either the first or second connector assembly 10, 70 include a panel aperture 124 having opposed first and second aperture flats 126, 128. Each of the first and second aperture flats 126, 128 are spaced having an aperture flat spacing dimension "L", allowing the mount flats 24*a*, 24*b* of first connector assembly 10 or the mount flats 122*a*, 122*b* of second connector assembly 70 to abut against the first and second aperture flats 126, 128, thereby minimizing axial rotation of either first connector assembly 10 or second connector assembly 70. Panel aperture 124 also includes an aperture maximum width "K" which slidably receives either the threaded connection portion 14 of first connector assembly 10 or the threaded connection portion 72 of second connector assembly 70. The panel aperture 124 is positioned with respect to a panel aperture central axis 130. In the example shown in FIG. 10, the spacing dimension "C" between panel aperture central axis 130 and a bore central axis 132 of bore 52 is depicted. Where bore 110 is provided, bore 110 is similarly located with respect to spacing dimension "H". To further orient either bore 52 or bore 110, the bore central axis 132 is positioned with respect to both a first axis locating dimension "M" and a second axis locating dimension "N". The first and second axis locating dimensions "M", "N" can be varied to suit the configuration of first or second connector assemblies 10, 70, as well as with respect to the orientation of first and second aperture flats 126, 128.

Figure 8:
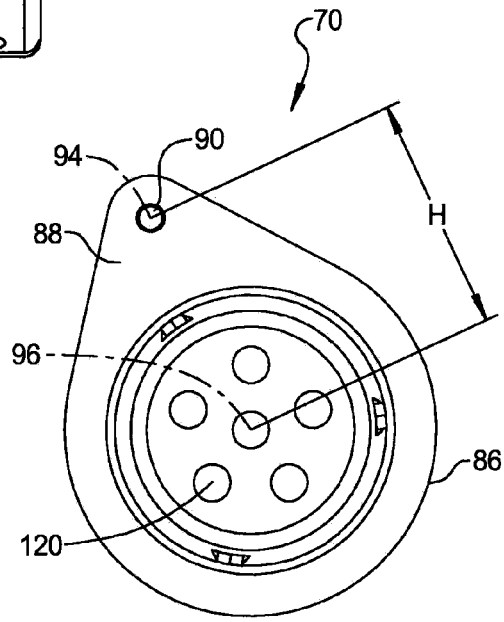
FIG. 8 is a rear end elevational view of the connector of FIG. 6.

Referring to FIG. 11 and again to FIGS. 3, 4 and 8, an exemplary installation of first connector assembly 10 is shown. First connector assembly 10 is installed by initially aligning thread flat 20*a* and mount flat 24*a* parallel with first aperture flat 126 and further aligning thread flat 20*b* and mount flat 24*b* parallel with respect to second aperture flat 128. This alignment also co-axially aligns anti-rotation member longitudinal axis 34 with bore central axis 132. The threaded connection portion 14 can thereafter be inserted through panel aperture 124 while simultaneously inserting anti-rotation member 30 within bore 52. It is common for bore 52 to be a blind bore which further assists with sealing connector assembly 10 to panel 50. A boss (not shown) can also be provided on second panel face 60 of panel 50 aligned with bore 52 to provide additional panel thickness to create bore 52 as a blind bore. The spacing dimensions "C" and/or "H" are therefore selected in part to provide clearance between the panel nut 38 and the boss. Once contact is made between first connector assembly 10 and first panel face 56, the panel nut 38 is threadably engaged with mounting threads 18 and rotated in a torque application direction "P" to fix the position of first connector assembly 10 with respect to panel 50. As previously noted, application of torque to panel nut 38 in the torque application direction "P" does not result in axial rotation of first connector assembly 10 because of anti-rotational contact provided by anti-rotation member 30, as well as direct contact between mount flats 24*a*, 24*b* and the first and second aperture flats 126, 128. It is noted that the thread flats 20*a*, 20*b* are provided to permit slidable insertion of threaded connection portion 14 into panel aperture 124 while providing clearance with respect to first and second aperture flats 126, 128.

Anti-rotation members of the present disclosure, such as anti-rotation members 30, 92, are depicted herein as pins; however, the geometry of anti-rotation members of the present disclosure are not limited to pins. This geometry can include substantially any geometric shape (e.g., oval, rectangular, triangular, star-shaped, or the like) providing the geometry of the bore in the panel is configured to slidably receive the anti-rotation member such that subsequent axial rotation of the connector assembly does not occur. According to several embodiments, anti-rotation members 30, 92 are precision pins available as Part No. 90145A415 from McMaster-Carr of Aurora, Ohio. Use of these precision pins coincides with matching the diameter of the panel bore within ±0.0005 inches of the diameter of the anti-rotation member. According to several embodiments, the diameter of the panel bore is reamed to achieve this pin-to-bore tolerance.

Connector assemblies of the present disclosure offer several advantages. Connector assemblies known in the art which employ only the oppositely positioned aperture flats as described herein are still susceptible to rotation when the panel nut is torqued to a desired torque range. It is known that a torque applied above 40 inch pounds is required to prevent loosening of the panel nut; however, in applications where a desired torque of up to approximately 120 inch pounds for the panel nut is desired, this range twists the connector assembly causing damage to the soldered conductor pins. Placement of the anti-rotation members of the present disclosure away from the longitudinal axis of the connector assembly precludes co-axial rotation of the connector assembly during installation of the panel nut. The use of additional fixtures to hold the connector assembly as known in the art is therefore eliminated by the use of anti-rotation members of the present disclosure. The addition of an integrally connected wing portion of the present disclosure to the connector body otherwise permits the connector assembly to meet all requirements for the connector assembly, such as those imposed by MIL-DTL-55116. Connector assemblies employing anti-rotation members of the present disclosure are not limited however to MIL-DTL-55116 assemblies, as the use of anti-rotation members of the present disclosure can be employed with any connector assembly designs.

Under the general specification MIL-DTL-55116, the requirements of which are incorporated herein by reference, MIL-DTL-55116/10 provides requirements for multiple pin connectors for use in panel mount applications, and provides a spacing dimension between mounting flats. Connectors manufactured to the requirements of MIL-DTL-55116 and MIL-DTL-55116/10 are improved by the addition of the anti-rotation members (such as pins 30) of the present disclosure which prevent axial rotation of the connectors when received in a mating panel aperture where the connector includes opposed mount flats meeting the spacing dimensions "E" and "J" as shown in FIGS. 4 and 9 as specified in MIL-DTL-55116/10. An exemplary spacing dimension "E" or "J" across the mount flats is 1.63 cm to 1.65 cm (0.640 to 0.650 in) as specified in MIL-DTL-55116/10.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

An interference fit as used herein is defined as a fit always ensuring some interference between the aperture or bore and the pin or male member wherein an upper limit size of the aperture or bore is smaller or at least equal to a lower limit size of the pin or male member. The interference fit creates a fixed (non-demountable) coupling of the pin or male member within the aperture or bore.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An electrical connector assembly, comprising a connector, including:

a connector body having a connector longitudinal axis;

a threaded connection portion having a plurality of mounting threads and axially extending from the connector body co-axial to the connector longitudinal axis, wherein the threaded connection portion extends through an aperture in a panel in an installed condition;

a mount portion having a substantially cylindrical shape integrally connecting the connector body to the threaded connection portion defining a seal cavity created external to the mount portion and internal with respect to an external wall of the connector body; and a wing portion connected to the connector body and extending radially outward with respect to the connector longitudinal axis;

an anti-rotation member fixed to the wing portion, the anti-rotation member further defined as a pin without threads that extends away from the wing and oriented on an anti-rotation member longitudinal axis aligned substantially parallel to the connector longitudinal axis, and a panel nut threadably engaged with the mounting threads of the connector in the installed condition, such that the pin is slidably received in a bore created in a panel to prevent axial rotation of the connector assembly with respect to the connector longitudinal axis when the torque is applied to the panel nut.

2. The connector of claim 1, wherein the threaded connection portion includes at least one thread flat oriented tangentially to the threaded connection portion.

3. The connector of claim 2, wherein the at least one thread flat includes opposed and parallel first and second thread flats.

4. The connector of claim 2, further including a mount portion connecting the threaded connection portion to the body, the mount portion having opposed and parallel mount flats each aligned with one of the first and second thread flats.

5. The connector of claim 1, wherein the wing portion includes a wing aperture oriented substantially parallel to the connector longitudinal axis.

6. The connector of claim 5, wherein the pin is frictionally retained within the wing aperture.

7. The connector of claim 6, wherein the pin is a precision pin having a pin diameter selected to be received in the pin fixing aperture creating an interference fit.

8. The connector of claim 1, further including a plurality of first conductor pins extending from a first end of the connector body and a plurality of second conductor pins extending from a second end of the connector body.

9. The connector of claim 1 wherein the pin is fixed to the wing portion at a distance radially from the connector longitudinal axis such that the radial distance exceeds a radius of the panel nut.

10. An electrical connector assembly, comprising:

a connector body having a connector longitudinal axis;

a threaded connection portion axially extending from the connector body co-axial to the connector longitudinal axis and having a first conductor pin cavity, the threaded connection portion having a plurality of mounting threads;

a plurality of first conductor pins positioned in the first conductor pin cavity;

a wing portion integrally connected to the connector body, the wing portion having an aperture oriented substantially parallel to the connector longitudinal axis; and a pin fixed in the aperture of the wing portion having a portion of the pin extending away from the wing portion such that a longitudinal axis of the pin is oriented substantially parallel to the connector longitudinal axis;

wherein the connector assembly meets the requirements specified in MIL-DTL-55116.

11. The electrical connector assembly of claim 10, further including an end face of the connector body oriented perpendicular to the connector longitudinal axis contacting a first panel face of a panel in an installed condition of the connector assembly.

12. The electrical connector assembly of claim 11, further including:

a panel nut threadably engaged with the mounting threads and rotated until a nut end face contacts a second panel face of the panel; and a torque ranging from approximately 40 inch pounds to approximately 120 inch pounds applied to the panel nut to prevent loosening of panel nut.

13. The electrical connector assembly of claim 12, where in the pin is slidably received in a bore created in the panel in the installed condition to prevent axial rotation of the connector assembly with respect to the connector longitudinal axis when the torque is applied to the panel nut.

14. The electrical connector assembly of claim 11, further including:

a plurality of first conductor pins positioned within a first body portion of the connector body oriented parallel to the connector longitudinal axis and extending outwardly with respect to the panel nut; and a plurality of second conductor pins oriented parallel with respect to the connector longitudinal axis positioned within a second body portion of the connector body.

15. The electrical connector assembly of claim 11, further including:

a mount portion of the connector body having opposed mount flats;

the panel receiving the threaded connection portion of the connector assembly includes a panel aperture having opposed first and second aperture flats, each of the first and second aperture flats spaced having an aperture flat spacing dimension allowing the mount flats to abut against the first and second aperture flats thereby minimizing axial rotation of the connector assembly.

16. An electrical connector assembly, comprising:

a connector body having a connector longitudinal axis;

a threaded connection portion axially extending from the connector body co-axial to the connector longitudinal axis and having a first conductor pin cavity, the threaded connection portion having a plurality of mounting threads;

a plurality of first conductor pins positioned in the first conductor pin cavity;

a wing portion integrally connected to the connector body, the wing portion having an aperture oriented substantially parallel to the connector longitudinal axis; and a pin fixed in the aperture of the wing portion having a portion of the pin extending away from the wing portion such that a longitudinal axis of the pin is oriented substantially parallel to the connector longitudinal axis;

an end face of the connector body oriented perpendicular to the connector longitudinal axis contacting a first panel face of a panel in an installed condition of the connector assembly;

a mount portion of the connector body having opposed mount flats;

the panel receiving the threaded connection portion of the connector assembly includes a panel aperture having opposed first and second aperture flats, each of the first and second aperture flats spaced having an aperture flat spacing dimension allowing the mount flats to abut against the first and second aperture flats thereby minimizing axial rotation of the connector assembly;

wherein a spacing dimension between the opposed mount flat is 0.640 to 0.650 in. as specified in MIL-DTL-55116/10.

17. The electrical connector assembly of claim 11, wherein the installed position further includes:

a panel aperture of the panel having the threaded connection portion inserted therethrough;

a bore created in the panel having the pin slidably received therein, the bore co-axially aligned with the pin;

a seal cavity created in the connector body having a connector seal positioned therein; and a wing portion end face and a planar end face of the connector body oriented co-planar with each other, the planar end face contacting a first panel face of the panel compressing the connector seal.

18. The electrical connector assembly of claim 17, further including a panel nut threadably engaged with the mounting threads in a nut installation direction until a nut end face contacts a second panel face to complete the installation of the connector body in a opposite body installation direction opposite to the nut installation direction.

19. The electrical connector assembly of claim 17, wherein a diameter of the bore is within ±0.0005 inches of a diameter of the pin.

* * * * *